US010077557B2

(12) United States Patent
Joly et al.

(10) Patent No.: US 10,077,557 B2
(45) Date of Patent: Sep. 18, 2018

(54) CORNER PIECE FOR RAIN GUTTERS AND METHOD OF MANUFACTURE

(71) Applicants: Robert E. Joly, South Rockwood, MI (US); Robert Brayman, Flatrock, MI (US)

(72) Inventors: Robert E. Joly, South Rockwood, MI (US); Robert Brayman, Flatrock, MI (US)

( * ) Notice: Subject to any disclaimer, the term of this patent is extended or adjusted under 35 U.S.C. 154(b) by 0 days.

(21) Appl. No.: 15/878,500

(22) Filed: Jan. 24, 2018

(65) Prior Publication Data

US 2018/0155932 A1 Jun. 7, 2018

Related U.S. Application Data

(62) Division of application No. 14/156,598, filed on Jan. 16, 2014, now Pat. No. 9,879,429.

(60) Provisional application No. 61/809,934, filed on Apr. 9, 2013.

(51) Int. Cl.
*E04D 13/064* (2006.01)
*B21D 51/16* (2006.01)
*B21D 5/16* (2006.01)

(52) U.S. Cl.
CPC ..... *E04D 13/0643* (2013.01); *B21D 5/16* (2013.01); *B21D 51/16* (2013.01)

(58) Field of Classification Search
CPC ..... E04D 13/0643; B21D 5/16; B21D 51/16
See application file for complete search history.

(56) References Cited

U.S. PATENT DOCUMENTS 1,546,688 A * 7/1925 Tanzola ..... B60J 3/002 160/352
1,866,467 A * 7/1932 Harriss ..... B21D 51/383 220/258.3
2,911,690 A * 11/1959 Sanford
3,127,862 A * 4/1964 Presnick ..... B21D 51/2646 29/428
3,890,230 A * 6/1975 Patterson ..... E04H 4/1227 210/167.12
3,923,230 A * 12/1975 Patterson ..... B23K 9/0026 210/167.12
3,987,712 A * 10/1976 Croteau ..... B23Q 35/42 144/136.95
4,092,808 A * 6/1978 Maloney, Jr. ..... E04D 13/064 29/DIG. 32
4,179,761 A * 12/1979 Corna ..... E04H 4/0075 210/167.12
4,223,487 A * 9/1980 St. Clair ..... E04D 3/3601 52/11

(Continued)

FOREIGN PATENT DOCUMENTS

CA 2827257 A1 * 8/2012 ..... E04C 2/08
DE 102015216772 A1 * 3/2017 ..... F23R 3/002
FR 3039787 A1 * 2/2017 ..... B42D 1/006

*Primary Examiner* — Jeanette E Chapman
(74) *Attorney, Agent, or Firm* — John R. Benefiel

(57) ABSTRACT

A corner piece for a rainwater gutter system having an angled front wall extending at a 45 degree angle to increase the amount of water able to be collected by the corner piece, with each end of a main section of the front wall having an angled out wing section slidably receiving an end of one of the straight gutter sections. The manufacturing method minimizes scrap by the shape of a blank used to form the corner piece.

7 Claims, 10 Drawing Sheets

(56) References Cited

U.S. PATENT DOCUMENTS 4,316,571 A * 2/1982 Corna ..... E04H 4/0075 228/173.6
4,333,208 A * 6/1982 Fuller ..... E04D 13/076 210/474
4,338,808 A * 7/1982 Weiss ..... B21D 5/16 248/48.2
4,471,932 A * 9/1984 Weiss ..... B21D 5/16 248/300
4,667,448 A * 5/1987 Smith ..... E04D 13/076 52/11
5,316,165 A * 5/1994 Moran, Jr. ..... H02G 3/10 220/3.2
5,469,681 A * 11/1995 Wu ..... E04B 9/064 403/174
5,491,998 A * 2/1996 Hansen ..... B21D 5/08 52/12
6,035,587 A * 3/2000 Dressler ..... E04D 13/0459 52/716.2
6,073,398 A * 6/2000 Williams ..... E04D 13/076 52/11
6,085,466 A * 7/2000 Martin ..... E04D 13/076 52/11
6,497,816 B2 * 12/2002 Naddy ..... B01D 29/336 210/162
6,523,575 B1 * 2/2003 Mrsny ..... B21C 37/296 138/109
7,318,282 B2 * 1/2008 Pulte ..... E04D 13/064 264/137
7,686,188 B2 * 3/2010 Stebick ..... B65D 47/122 222/109
8,151,616 B2 * 4/2012 Isomaki ..... 72/379.2
8,272,170 B2 * 9/2012 Argentina ..... E04D 13/0645 52/11
8,413,386 B2 * 4/2013 Fazekas ..... E04B 1/003 52/302.6
8,474,192 B2 * 7/2013 Horton ..... E04D 13/076 52/11
8,567,143 B2 * 10/2013 Kalwara ..... E04D 13/1407 52/309.1
8,631,611 B2 * 1/2014 Kalwara ..... E04D 13/1407 428/40.1
8,763,310 B2 * 7/2014 Dehart, Sr. ..... E04D 13/0643 52/11
9,062,460 B2 * 6/2015 Dehart, Sr. ..... E04D 13/0643
9,133,622 B2 * 9/2015 Kalwara ..... E04D 13/064
9,441,381 B2 * 9/2016 Hatch ..... E04F 19/02
9,447,626 B2 * 9/2016 Murphy ..... E06B 1/70
9,879,429 B2 * 1/2018 Joly, Jr. ..... E04D 13/0643
D809,645 S * 2/2018 Poehlman ..... E04F 17/08 D23/393
2003/0150114 A1 * 8/2003 Reyal ..... 29/897.3
2005/0279036 A1 * 12/2005 Brochu ..... E04D 13/0643 52/287.1
2006/0090404 A1 * 5/2006 Lovell ..... E04D 13/0481 52/97
2006/0225368 A1 * 10/2006 Roe ..... E04D 13/064 52/12
2009/0288349 A1 * 11/2009 Wootton ..... E04D 13/064 52/12
2011/0283630 A1 * 11/2011 Beckham ..... E04D 13/0725 52/12
2012/0318314 A1 * 12/2012 Okuda ..... E04H 1/1205 135/96
2014/0047779 A1 * 2/2014 Dehart, Sr. ..... E04D 13/0643 52/11
2014/0202086 A1 * 7/2014 Reese ..... E04D 13/076 52/12
2016/0199897 A1 * 7/2016 Otsuka ..... B21D 22/26 72/352

* cited by examiner

CORNER PIECE FOR RAIN GUTTERS AND METHOD OF MANUFACTURE

CROSS REFERENCE TO RELATED APPLICATIONS

This application is a divisional of U.S. Ser. No. 14/156,598 filed Jan. 16, 2014 which claims the benefit of U.S. provisional application No. 61/809,934 filed on Apr. 9, 2013.

BACKGROUND OF THE INVENTION

This invention concerns rain gutters installed beneath roof eaves to collect rainwater runoff. The roof eaves sometimes form inside corners where roof sections pitched in different directions intersect, which requires an inside corner piece connected to straight gutter sections along each of the eaves forming the inside corner. A problem is created by an increased volume of rainwater runoff collected by a roof valley formed between the different roof sections. Since the increased flow volume directed into the inside corner piece causes overflow of rainwater over the top portion of the inside corner piece if it is not big enough to contain this increased volume.

Various solutions have been proposed to eliminate such overflows such as diverter baffles and rain water distributors, as shown in U.S. Pat. Nos. 2,899,912; 2,120,395 and 7,765,743; and patent publication nos. US 2002/0124476; US 2001/0017008; US 2002/0124476; and US 2002/0152691.

Such baffles and diverters are relatively expensive and add to the labor of installing a gutter system, and also often do not work well.

Another solution which has been proposed is to increase the capacity of the corner piece by providing a front wall extending across the inside corner at a 45 degree angle which widens the corner piece, as shown in U.S. Pat. Nos. 6,883,760; 2,537,243 and 2,120,395. The inside corner pieces described in the latter two patents are adapted to a simple semicircular gutter configuration formerly used.

In practice it has heretofore been too expensive to manufacture such 45° inside corner pieces matched to the standard curved and stepped shape of the front wall of roof gutters currently used and have not gained widespread commercial acceptance.

It is an object of the present invention to provide such an increased capacity corner piece and method of manufacture which can be made at a low enough cost to be commercially viable.

SUMMARY OF THE INVENTION

The above recited object of the invention and other objects which will be understood upon a reading of the follow specification and claims are achieved by a corner rain gutter piece having a curved and stepped front wall extending at 45° and configured to match the curved stepped shape of the front wall now in widespread use. Two similarly shaped wing sections are provided, one on each side of a front wall main section, the wing sections angled out from the front wall main section.

A flat bottom panel extends back from the bottom side of the front wall to a pair of right angled upright walls each formed up from a side of the bottom panel and integral therewith.

Preferably, a back wall extension piece is attached to short upright back walls to be substantially of the same height as the back wall of a standard gutter section while facilitating manufacture of the corner piece.

A pair of straight gutter section each have an end received within a respective one of the pair of angled out wing sections of the front wall and are cut off to angle their ends, so as to have a bottom wall angled out to completely overlie the inside corner piece bottom panel and to be positioned against a respective back wall of the corner piece thereof to complete the connection of the straight gutter sections to the corner piece.

DETAILED DESCRIPTION

Figure 1:
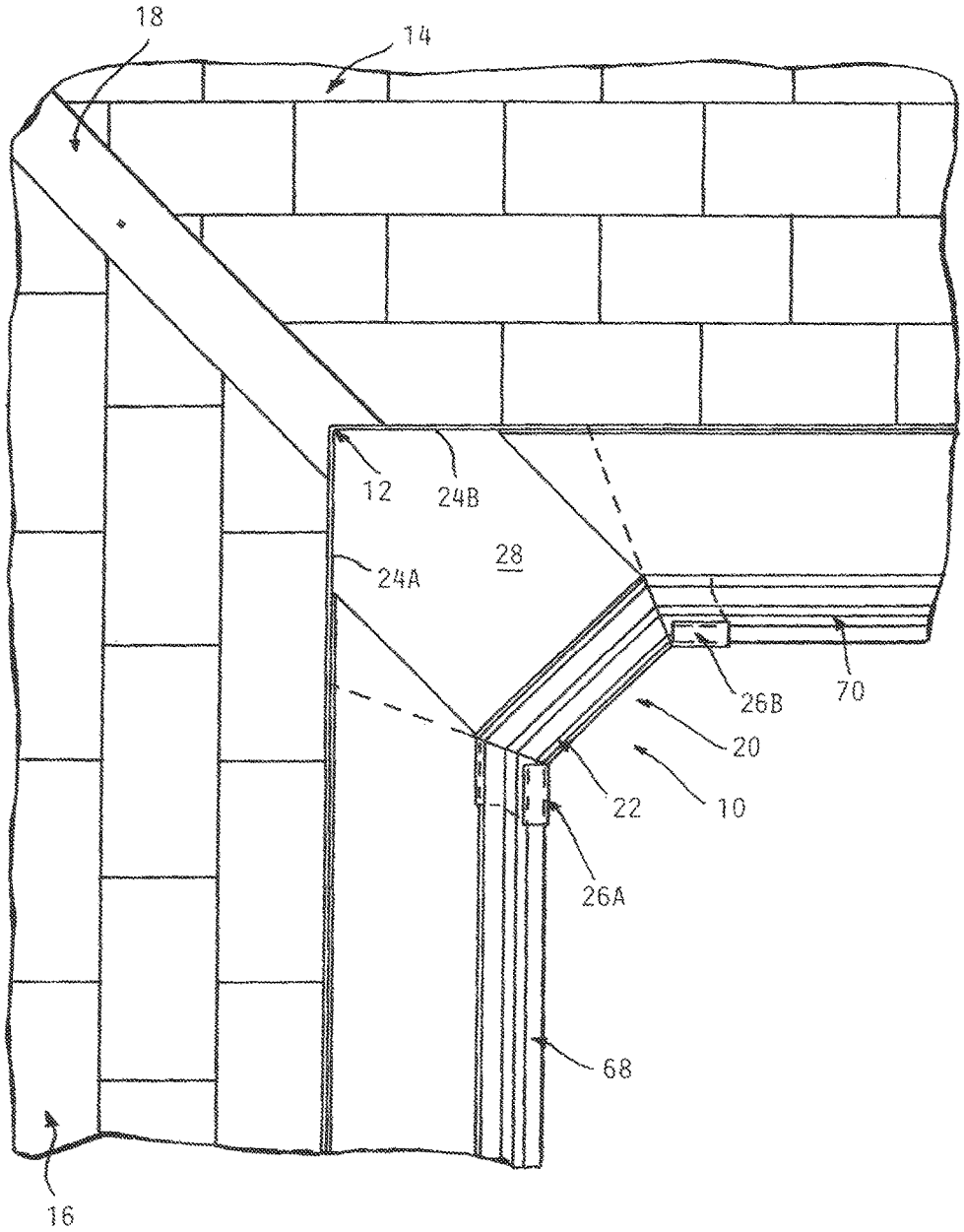
FIG. 1 is a plan view of an inside corner formed by two intersecting roof eaves with a rain gutter inside corner piece according to the invention installed at the inside corner and the ends of two straight rain gutter sections connected thereto.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings and particularly FIGS. 1-5, a corner piece 10 according to the invention is shown installed at an inside corner 12 formed by the intersection of two roof sections 14, 16 which are pitched in different directions so as to form a valley 18. The valley 18 descends to the inside corner piece 10 so that rain water collected in the valley runs off into the inside corner piece 10.

The corner piece 10 includes an upright front wall 20 having a main section 22 extending at about a 45° angle to a pair of upright rear wall section 24A, 24B extending at right angles to each other. A pair of wing sections 26A, 26B are angled out from the main front wall section 22 so that each of these extend parallel to a respective rear wall section 24A, 24B.

A flat bottom panel 28 joins the front wall main section 22 to the rear walls 24A, 24B to form the completed corner piece 10.

The wing sections 26A, 26B project out from respective ends of the main section 22 of the front wall 20 and beyond the sides 25 of the bottom panel 28 which each extend from a respective end of the front wall main section 22.

The front wall main section 22 and wing sections 26A, 26B each have a curved stepped shape in general conformity to the shape of the outer wall of gutters currently being installed. That is, a short vertical section 30 extends up from the bottom, with an integral formed sinuously curved intermediate section 32 extending up and out to a top portion 34 thereof.

Figure 2:
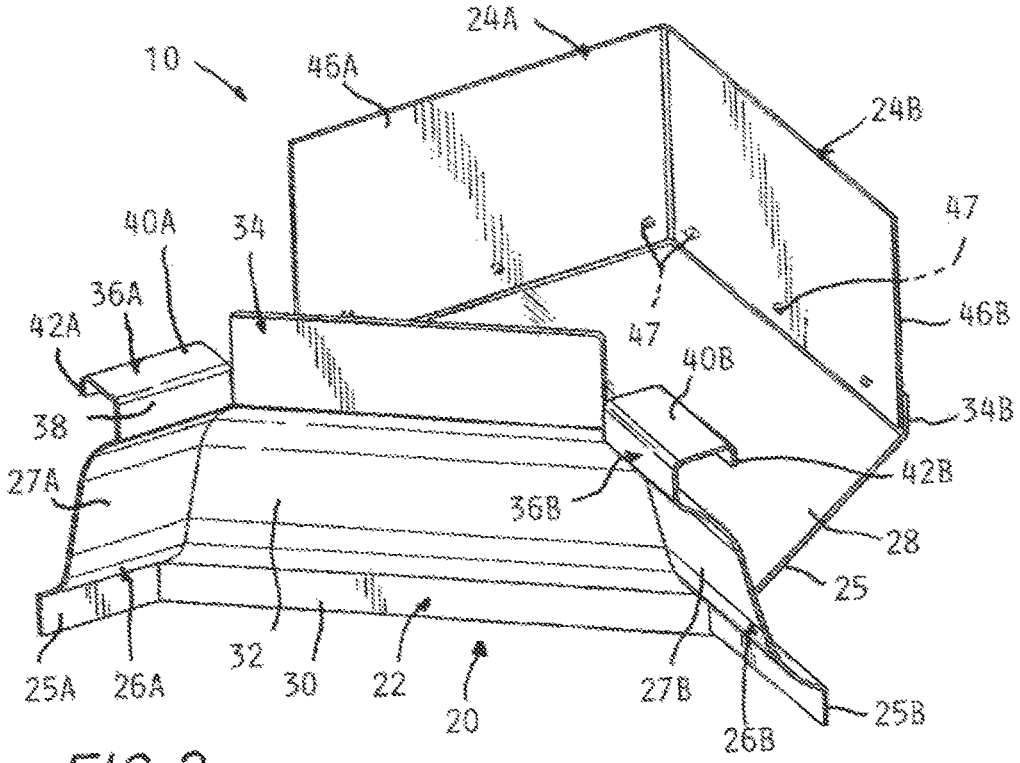
FIG. 2 is a pictorial view from the front of an inside corner piece for a rain gutter according to the invention.
Figure 3:
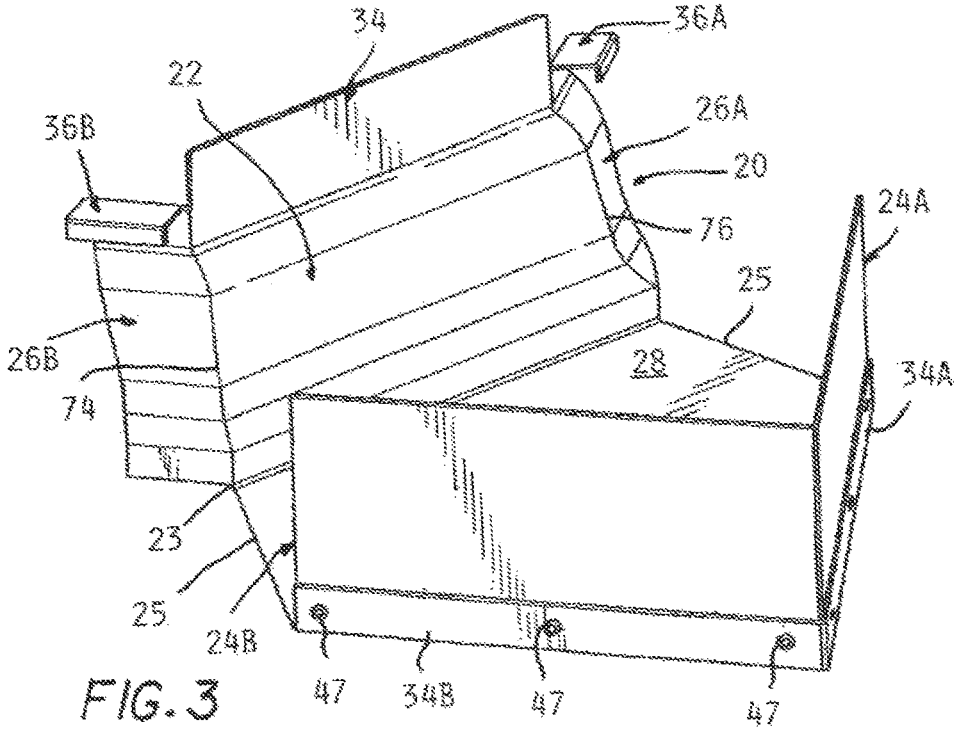
FIG. 3 is a pictorial view from the rear of the inside corner piece for a rain gutter shown in FIG. 2.
Figure 4:
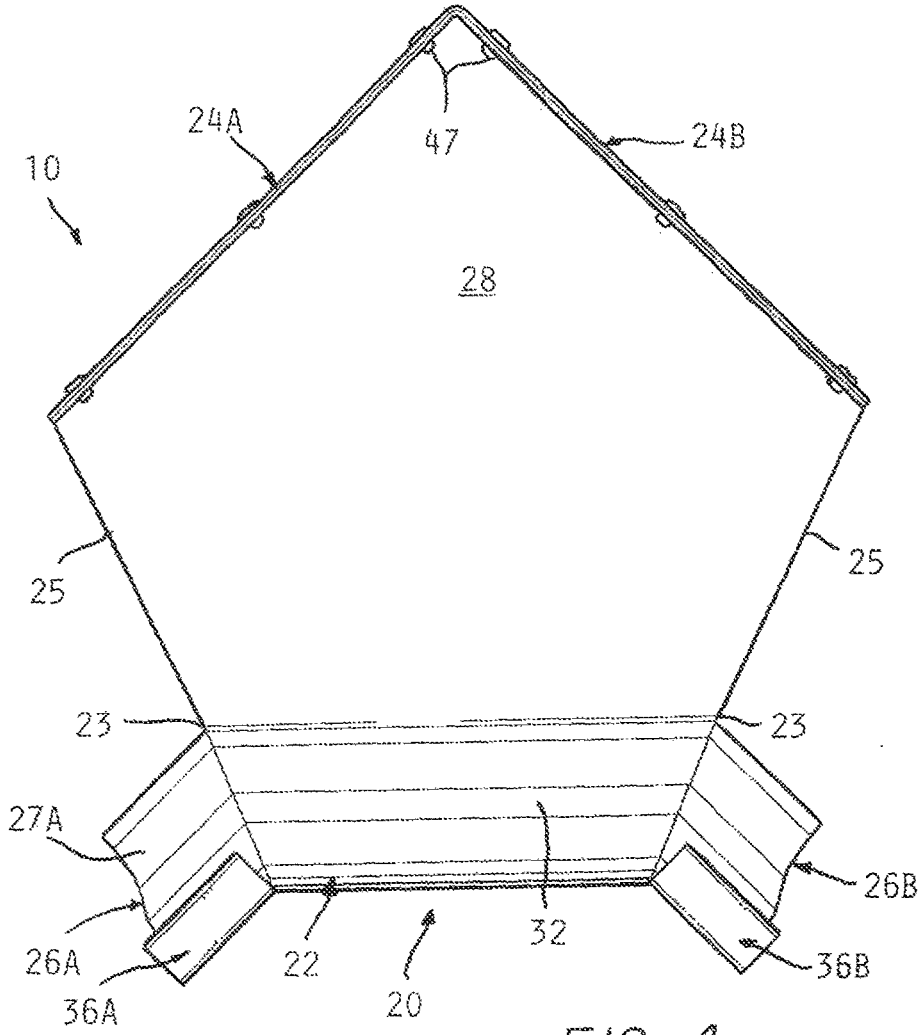
FIG. 4 is a plan view of the inside corner piece shown in FIGS. 2 and 3.
Figure 5:
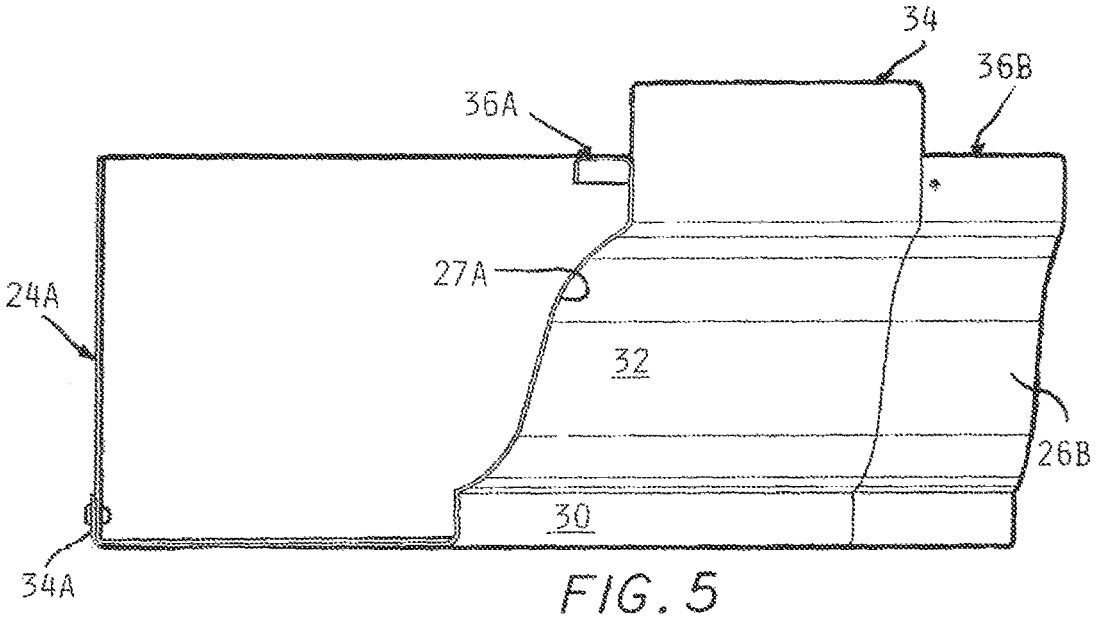
FIG. 5 is a side view from the right of the inside corner piece shown in FIGS. 1-4.
Figure 6:
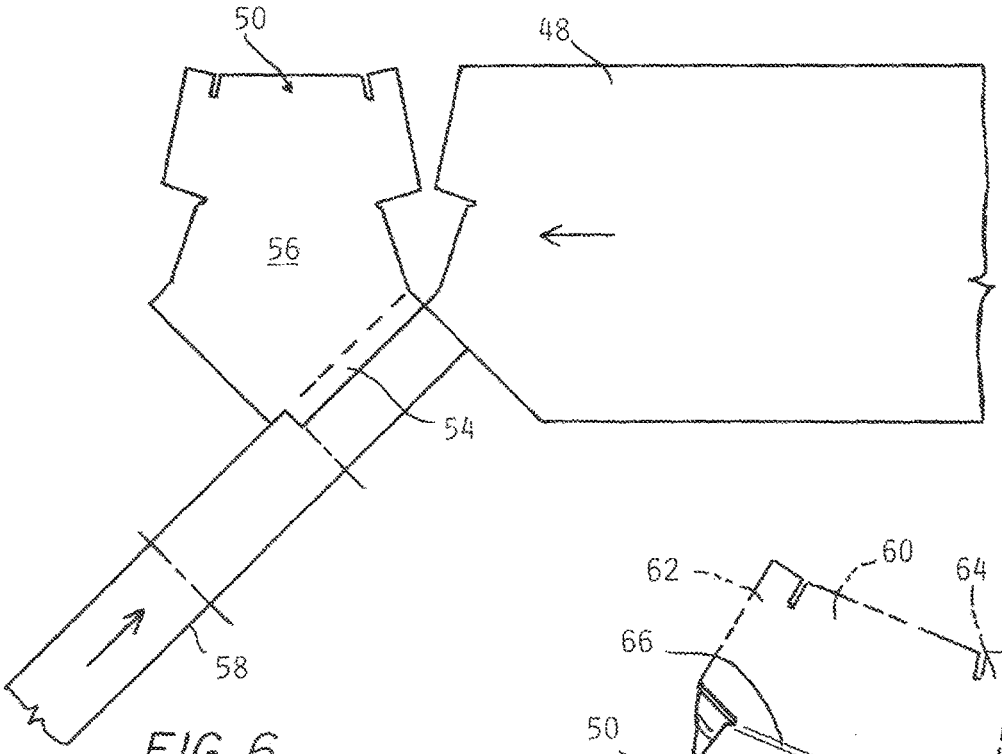
FIG. 6 is a plan view of the initial steps in making an inside corner piece for rain gutters according to the invention including cutting a blank from sheet aluminum.

The front wall main section 22 may have a top portion 34 which projects straight up as seen in FIGS. 2 and 3

Each of the wing sections 26A, 26B is shaped in the same way, with a short vertical section 25A, 25B and stepped curved sections 27A, 27B.

The top portion 36A, 36B or each of the wing sections 26A, 26B comprises a short vertical section 38A, 38B, a horizontal section 40A, 40B extending back towards a respective rear wall 24A or 24B and a short downwardly extending terminal edge 42A, 42B. This is the same shape as conventional gutter top portions only slightly larger so as to be able to slidably receive the ends of lengths of straight gutter sections, as described further below.

The rear walls 24A, 24B are comprised of short upturned sides 34A, 34B integral with the bottom panel 28 and an extension piece 46 formed with two integrally connected sides 46A, 46B extended at a right angle to each other, and staked or riveted at 47 to a respective formed up rear wall side 34A, 34B to extend the rear walls 24A, 24B to the full height of a conventional rain gutter.

The reasons for such a two piece construction is related to the cost of manufacture of the inside corner piece 10 as described in detail herein below.

Referring to FIGS. 6-13C, the manufacturing steps comprise cutting and forming operations preferably in a conventional progressive die set up.

Sheet aluminum 48 is advanced from a roll of a width sufficient to allow a blank 50 to be cut therefrom (not shown) in a first step.

Figure 6A:
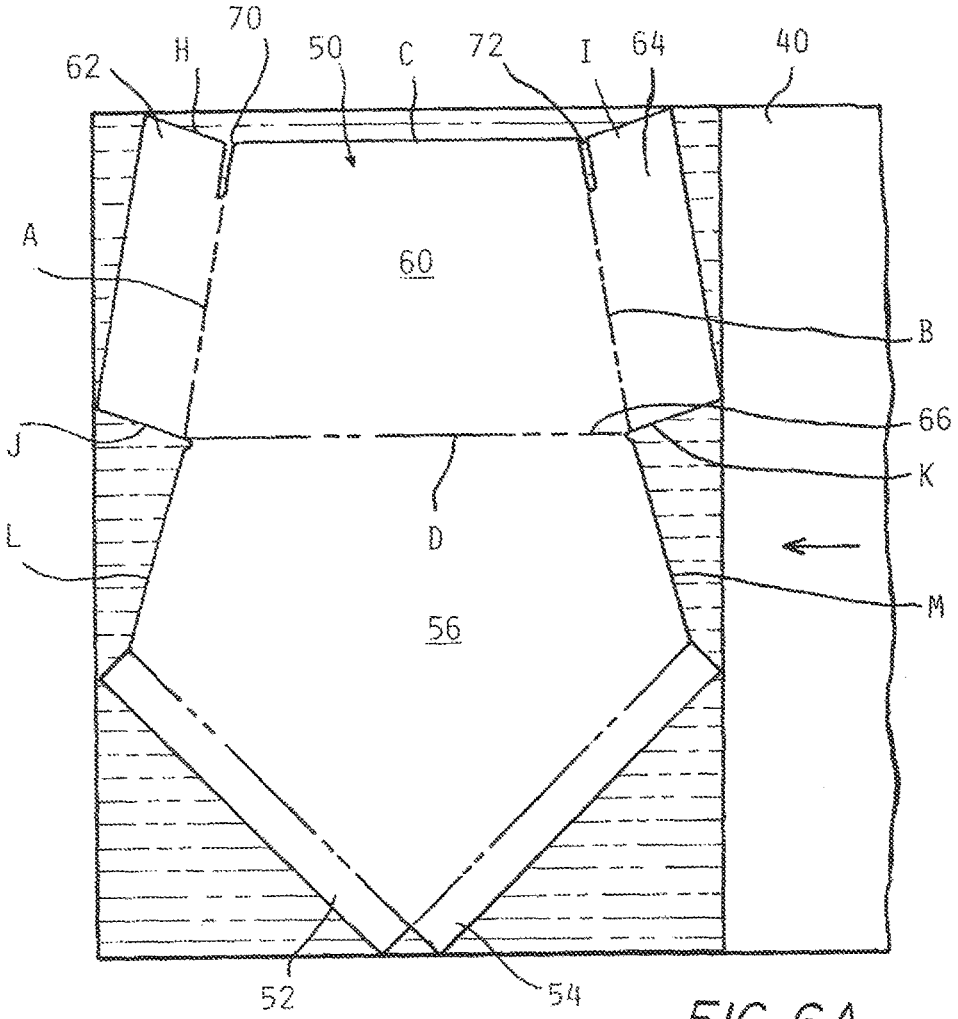
FIG. 6A is an enlarged view of the blank cut out in the initial forming step with scrape areas shown covered with horizontal broken lines.
Figure 16A:
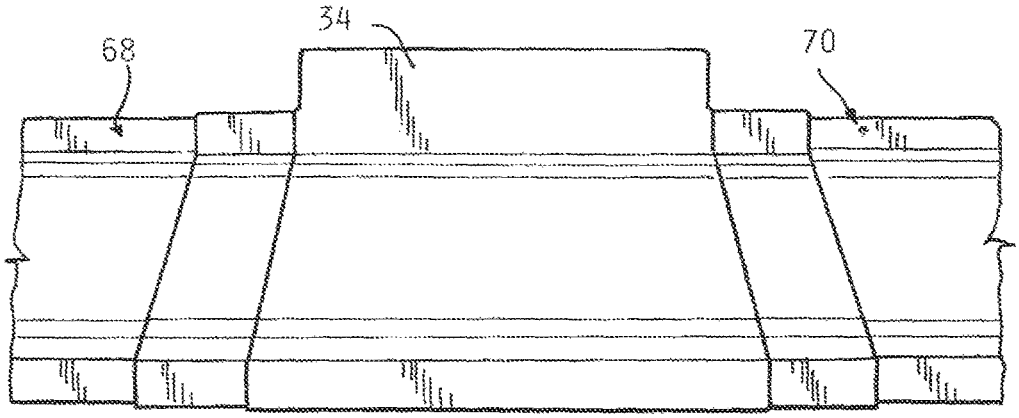
FIG. 16A is an enlarged front view of a corner piece according to the invention with fragmentary end portions of straight rain gutter sections installed therein.

The blank 50 has two narrow strip areas 52, 54 on the leading and trailing sides of the blank 50 respectively, projecting from a region 56 from which will be formed the bottom panel 28 of the inside corner piece 10 (FIG. 6A).

A second strip of aluminum sheet 58 is fed off a roll (not shown) in a next step so as to underlie the trailing strip 54.

The width of the strip aluminum 58 corresponds to the finished height of the rear walls 24A, 24B.

Figure 7:
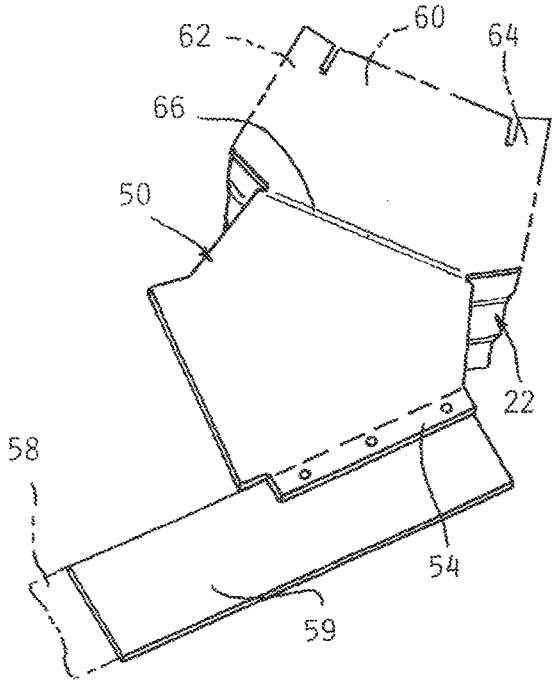
FIG. 7 is a pictorial view of a next intermediate step in making the inside corner piece according to the invention.

In the next step indicated in FIG. 7, the strip 58 is cut off to length to form a rear wall extension piece 59, on end thereof staked or riveted to the underside of strip 54.

Simultaneously a front piece 60 of the blank 50 is formed into the curved stepped shape of the front wall 20. The wing sections 26A, 26Bs are formed from the subregions 62, 64 of the blank 50. The front wall 20 is also bent down along line 66 between regions 56 and 60 of the blank 50.

Figure 8:
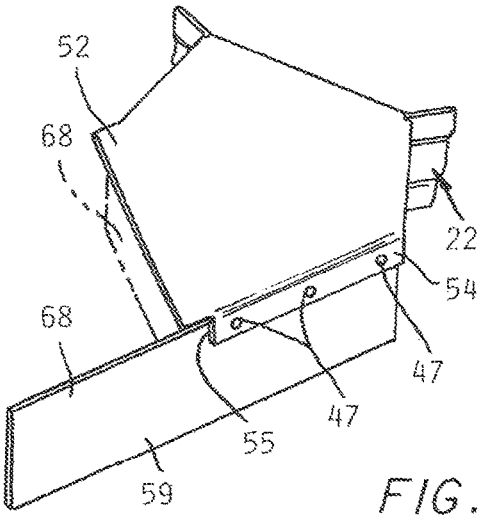
FIG. 8 is a pictorial view of a next intermediate step in making an inside corner piece according to the invention.

In the next step, the trailing strip 54 and attached extension piece 59 is formed down 90° as seen in FIG. 8.

Figure 9:
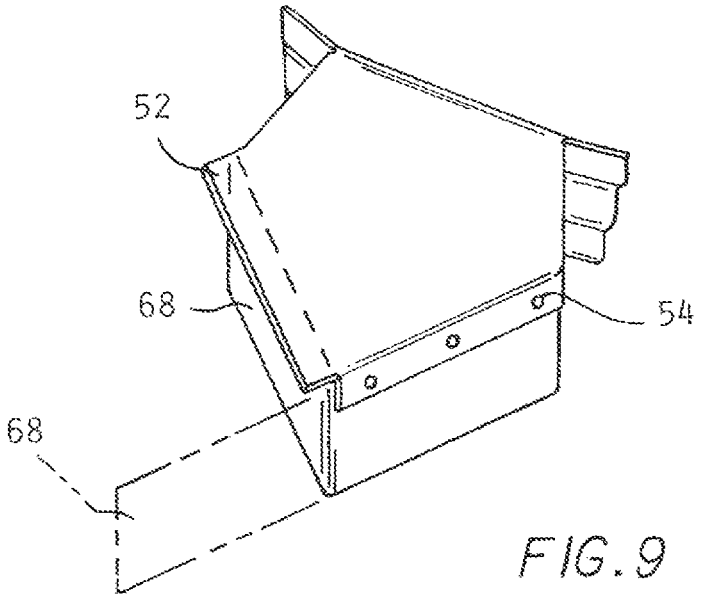
FIG. 9 is a pictorial view of a next intermediate step in making an inside corner piece according to the invention.

The projecting end 68 of the strip 54 is formed back 90° under the leading strip 52 aligned with one end 45 of the strip 54, as shown in phantom lines in FIGS. 8 and 9.

Figure 10:
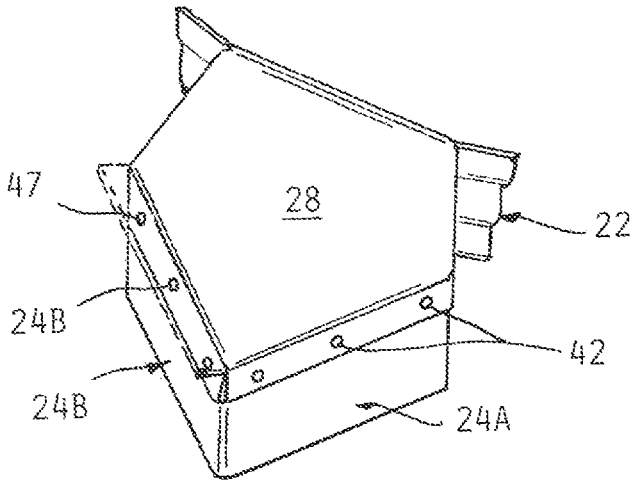
FIG. 10 is a pictorial view of a next intermediate step in making an inside corner piece according to the invention.
Figure 11:
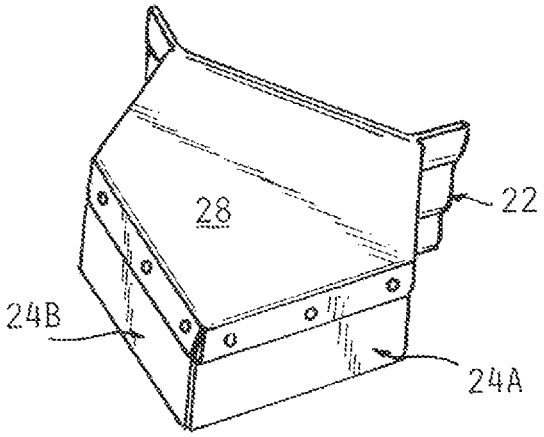
FIG. 11 is an inverted pictorial view of a completed corner piece according to the invention.
Figure 12:
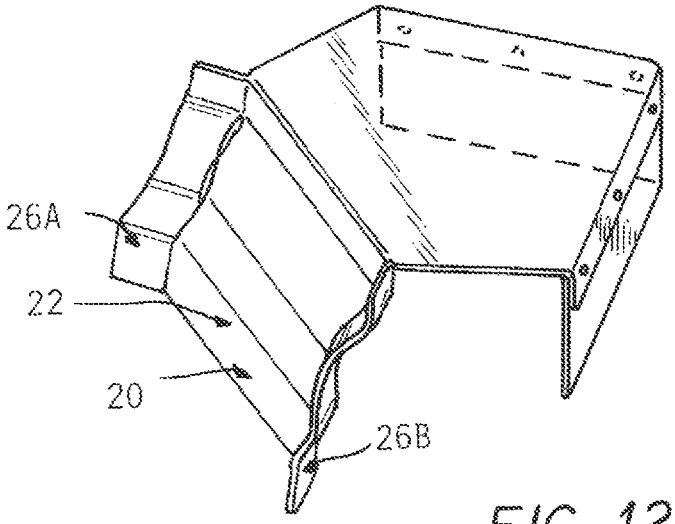
FIG. 12 is a pictorial view of an inverted partially completed inside corner piece according to the invention.

The leading strip 52 is then formed down and staked to the end 68 of extension piece 59, thus forming the back walls 24A, 24B (FIGS. 10 and 11).

Referring again to FIG. 6A, the blank 50 area 60 has a trapezoidal shape with a pair of sides A, B each sloping from the ends of an upper side C out to a longer lower side D (which constitutes fold line 26).

This inclines the sides of parallelogram shaped auxiliary strips 62, 64. When the area 60 is being shaped in the curved stepped shape it is folded up along 66D line 1 to be inclined up from the area 56 (forming the bottom panel 28), the auxiliary strips 62, 64 are simultaneously also folded up when being shaped in the same way. Area 60 becomes the main section 22 of the front wall 20. The auxiliary strips 62, 64 at the same time are folded out in relation to the folded up area 60 to be parallel to fold lines F, G. This forms the wing sections 20A, 20B of the front wall 12.

The shape and position of auxiliary strips 62, 64 causes the top edges H, I to be moved to be parallel to the top edge C of the area 60, and the bottom edges J, K to be parallel to the back walls 24A, 24B respectively.

Figure 15:
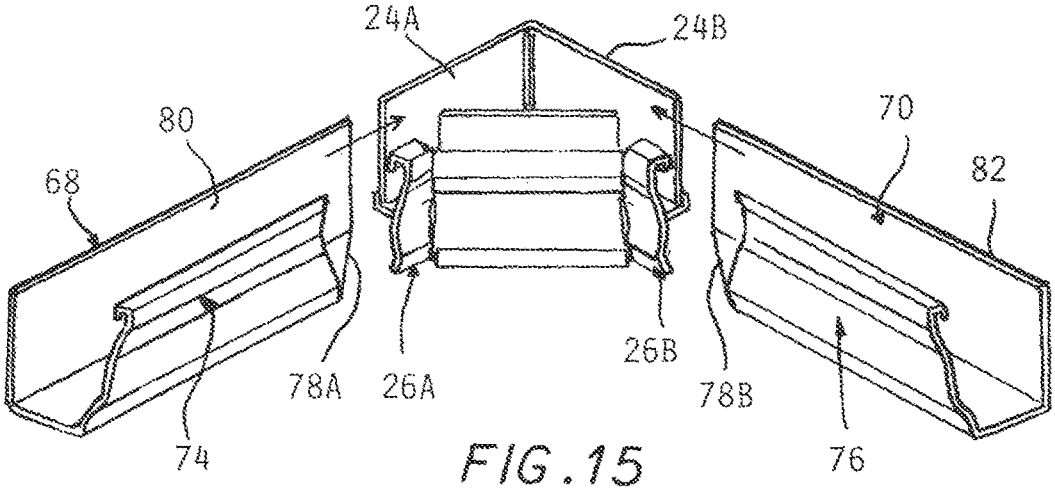
FIG. 15 is a pictorial exploded view of an inside corner piece according to the invention with a fragmentary view of mating angled ends of straight gutter sections.
Figure 16:
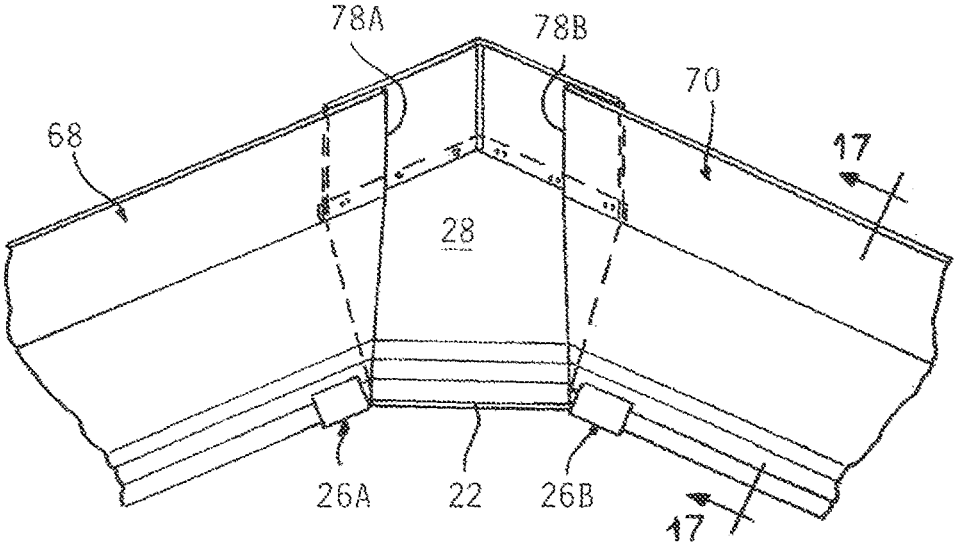
FIG. 16 is a pictorial view of the inside corner piece shown in FIG. 15 with the ends of straight gutter sections shown fit into respective sides of an inside corner piece according to the invention.
Figure 17:
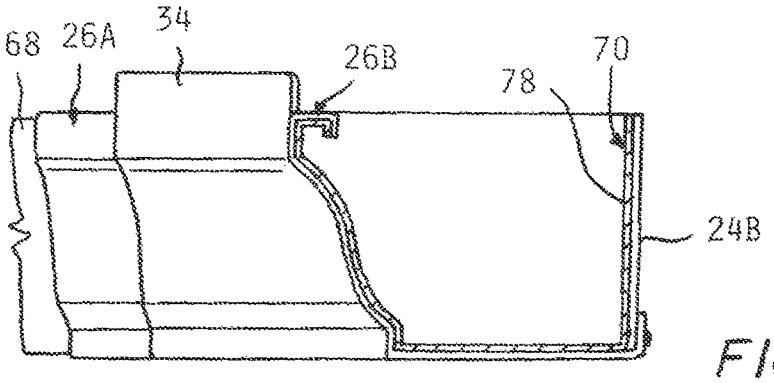
FIG. 17 is a view of the section taken in FIG. 16.
Figure 18:
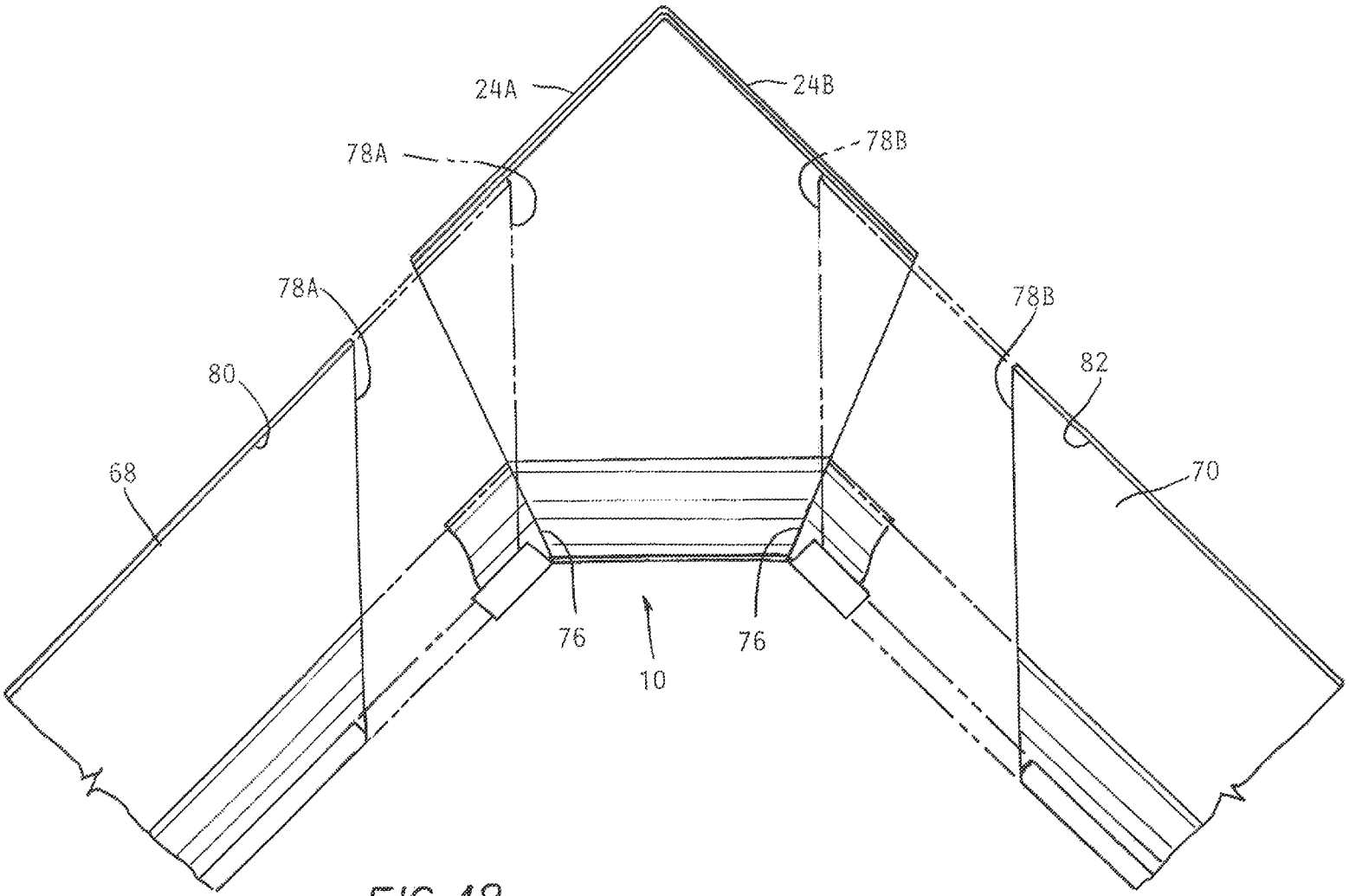
FIG. 18 is an enlarged plan view of an inside corner piece shown in FIGS. 15 and 16 with straight gutter sections ends being inserted into respective sides of an the inside corner piece according to the invention.

This results in the formed top portions 36A, 36B of the wing sections 26A, 26B to be aligned with the top portions and curved stepped front of the straight gutter sections 68, 70 (FIG. 15) to allow them to be inserted into the inside corner side piece 10 as shown in FIGS. 16 and 18.

The front wall main section 22 extends at about 45° to the back walls 24A, 24B and also to the installed straight gutter sections 68, 70.

This relationship creates an enlarged volume capacity of the inside corner piece 10 better able to contain the increased volume of rainwater runoff from the roof valley 18 (FIG. 1).

In order to minimize excessive scrap, lateral projections from the blank 50 are minimized, as can be seen in FIG. 6A where the areas of trimming scrap are indicated by horizontally broken lines. This is done here by minimizing both the length and the height of the short back walls 34A, 34B directly formed by the strips 52, 54 of the blank 50. The width of the blank is reduced by first forming the short walls 34A, 34B and then attaching the separate back wall extension 46A, 46B to complete the back walls 24A, 24B. The length of the back walls is reduced by angling the floor panel sides L, M back towards each other rather than at 90° to the wing section 26A, 26B as seen in FIG. 6A.

This necessitates cutting mating ends of the mated straight gutter sections 68, 70 at an angle as shown in FIGS. 15, 16 and 18.

The formed wing sections 26A, 26B slidably receive the shaped side of the straight sections 68, 70 which are advanced therein to the end of the respective wing section 26A, 26B. The straight section ends cannot be further advanced therein as they would create flow obstructions within the inside corner piece 10.

Since the length of the rear walls 24A, 24B does not extend out to be even with the end of the wing sections 26A, 26B, the straight sections must be cut along an angle of about 45° to overlap the bottom panel 28 and rear walls 24A, 24B as shown in FIGS. 15, 16 and 18.

Figure 13:
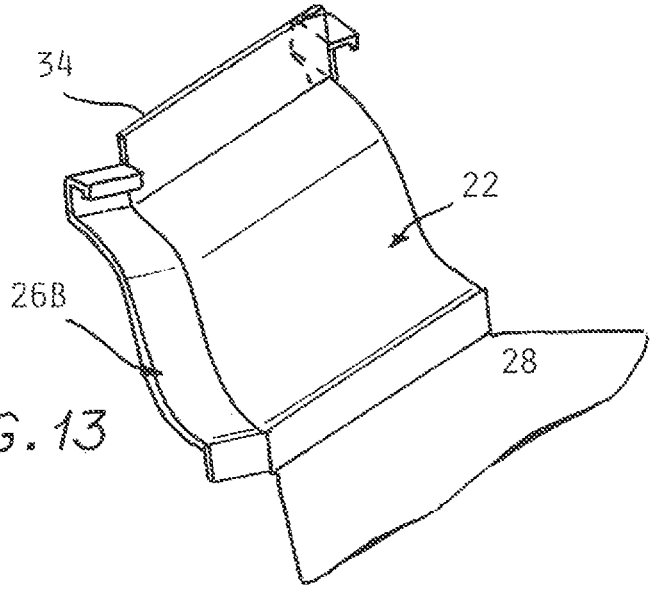
FIG. 13 shows additional forming of the top portion of a front wall of an inside corner piece according to the invention.

FIG. 11 shows the front wall 20 with the (inverted) top portion 34, 36A, 36B of the main section 20 and wing sections 26A, 26B yet to be formed. The forming of the portion can be done in a variety of ways, such as shown in FIGS. 2, 3 and 13 in which the main section top portion 24 is left straight up and the tops of the wing sections 36A, 36B formed over to match the mating gutter straight sections, but a little larger in size to slidably receive the same therein.

Figure 14A:
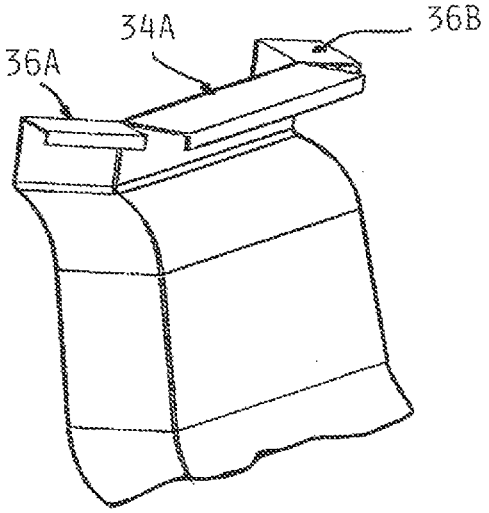
FIGS. 14A-14C are pictorial views of several variations in the configuration of the top portion of the front wall of an inside corner piece according to the invention.
Figure 14B:
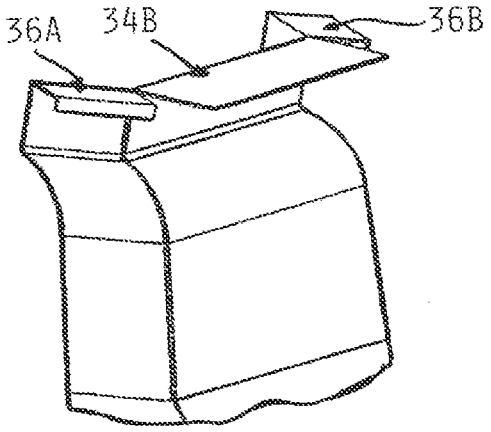
Figure 14C:
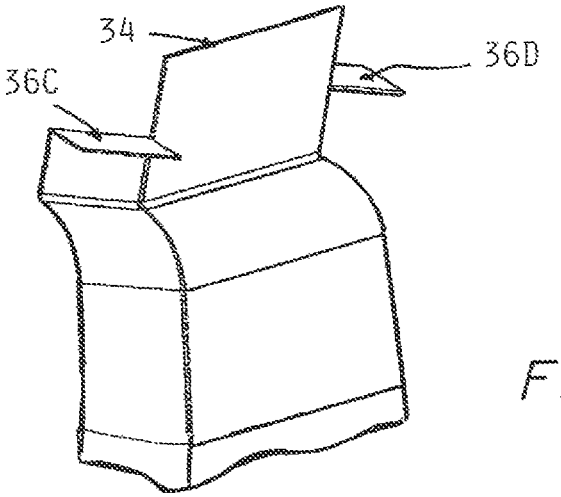

FIGS. 14A, 14B, 14C show other possible variations with FIG. 14A showing the main section top portion 34A formed over in a fashion similar to the top portions 36A, 36B of angled wing sections 26A, 26B.

The slits 72 formed into the blank 50 (FIG. 6A) accommodate the separate forming of the top portions 36A, 36B, 34A.

FIG. 14B shows the main section top portion 34B formed straight out with formed over wing section tops.

FIG. 14C shows the main section top portion 34 left straight up and wing section top portions 36C and 36D formed straight out.

FIGS. 15-18 show the connection of a inside corner piece 10 according to the invention to the two straight gutter sections 68 and 70 which would extend along the two roof eaves forming a corner.

The straight gutter sections 68, 70 mate with an end of the inside corner piece 10 by the ends 78A, 78B sliding within a respective wing sections 26A, 26B and the rear walls 80, 82 thereof within the rear walls 24A, 24B (FIG. 18).

Since the wing sections 26A, 26B each extend substantially further out towards the respective straight sections 68, 70 than the rear walls 24A, 24B, the straight sections 68, 70 must be cut off at angle. If their ends were squared off, the ends would need to extend well into the inside corner piece 10 past the corners 74, 76 (FIG. 13) which the wings 26A, 26B make with the main section 22 of the front wall 20. This would create turbulence and flow resistance with water flow out of the two ends of the corner piece 10 and likely create leaks.

Accordingly, the ends 78A, 78B of the straight sections 68, 70 are cut at an angle to locate the outer wall of each at the respective corners 74, 76 while each of the back walls 80, 82 thereof extend well past the ends of the back walls 24B, 24A as indicated in FIGS. 15-18 creating sufficient overlap to enable a sealed connected to be made.

Accordingly, the corner piece 10 can be made cheaply by conventional dies and minimal scrap to be commercially practical, thereby satisfying a long felt need in the industry.

The invention claimed is:

1. A method of manufacturing a corner piece for connecting to an inside pair of straight rain water gutters at a corner formed by a pair of roof eaves, said method comprising cutting out a blank from a piece of sheet metal, said blank having a front area at one end thereof, and also having a bottom panel area having angled end sides converging together at a substantially right angle to one another, and also having rear wall areas at an opposite end of said blank from said one end projecting from a respective end side of said bottom panel area;

said blank having a front wall area including a pair of auxiliary strips each projecting from a respective side of a main portion of said front wall area, said bottom panel area connected only to said main portion of said front wall area;

forming the main portion of said front wall area into a stepped and curved shape corresponding to a stepped and curved front outer wall of said straight standard rain water gutters while folding said main portion of said front wall area relative said bottom panel area along a front side thereof and at the same time forming said auxiliary strips into said similar stepped and curved shape of said front wall area main portion, and folding said auxiliary strips along a border with said main portion of said front wall area so as to be angled towards each other, front wall wing sections thereby formed from said auxiliary strips; and folding up said rear wall areas from said bottom panel area along said angled end sides thereof to form upright rear walls.

2. The method according to claim 1 wherein said upright rear walls areas are substantially shorter than said formed up front wall main portion and wing sections, and further including attaching a rear wall extension having two segments formed at right angles to each other of substantially the same length as both of said rear wall areas combined and of substantially the same height as said formed front wall wing sections.

3. The method according to claim 1 wherein in said folding step, said auxiliary strips are each angled towards each other so as to be substantially parallel to a respective one of said upright rear walls.

4. The method according to claim 3 wherein in cutting out said blank pattern said bottom panel areas are each cut to have sides extending from an end of a respective rear wall area to a respective end of said main portion of said front wall area.

5. The method according to claim 1 wherein a slit is cut into said blank along a border between each auxiliary strip and an adjacent main area of said front wall area to enable a separate forming of a top portion of each wing section and said main portion of said front wall area.

6. The method according to claim 1 wherein each auxiliary strip is cut to form a parallelogram with top and bottom edges at an angle to a respective side of said main portion of said front wall area so as to extend parallel thereto when said main portion of said front wall area is folded up and said auxiliary strips are folded up and angled with respect to said main portion of said front wall area.

7. The method according to claim 6 wherein a top of each front wall wing section is formed over to match allowing ends of said straight sections to be slidably received in each wing section top portion when said inside corner piece is being installed.

* * * * *